United States Patent [19]

DeLisle et al.

[11] Patent Number: 4,607,769

[45] Date of Patent: Aug. 26, 1986

[54] HAT BRIM PRESS

[76] Inventors: David S. DeLisle, P.O. Box 1732; James P. Marino, 79 West St., both of Lunenburg, Mass. 01462

[21] Appl. No.: 769,495

[22] Filed: Aug. 26, 1985

[51] Int. Cl.[4] ..... A42C 1/06

[52] U.S. Cl. ..... 223/12; 223/25

[58] Field of Search ..... 223/12, 13, 21, 24, 223/25, 14, 15, 22, 23, 26

[56] References Cited

U.S. PATENT DOCUMENTS

| | | | |
|---|---|---|---|
| 984,794 | 2/1911 | Brennan | 223/12 |
| 1,059,238 | 4/1913 | Vanderhoef | 223/12 |
| 1,539,758 | 5/1925 | Martin | 223/12 |
| 1,541,997 | 6/1925 | Page et al. | 223/12 |
| 2,038,698 | 4/1936 | Wolkenhauer | 223/25 |
| 3,220,016 | 11/1965 | Weist | 223/12 T |
| 3,305,874 | 2/1967 | Peham | 223/12 T |

*Primary Examiner*—Werner H. Schroeder
*Assistant Examiner*—Andrew M. Falik
*Attorney, Agent, or Firm*—John E. Toupal; Harold G. Jarcho

[57] ABSTRACT

A hat brim press including a base plate with a planar top surface portion for supporting the bottom of a hat brim; a cover plate having an annular, planar bottom surface for engaging the top of the hat brim; the cover plate defining a central opening encircled by the bottom surface and adapted to accommodate a crown attached to the hat brim; and fasteners connecting the base plate and the cover plate and manually adjustable to produce between the top surface portion and the bottom surface forces directed orthogonally thereto, the forces pressing the hat brim between the top surface portion and the bottom surface so as to retain the hat brim in a planar form.

17 Claims, 4 Drawing Figures

FIG. 1
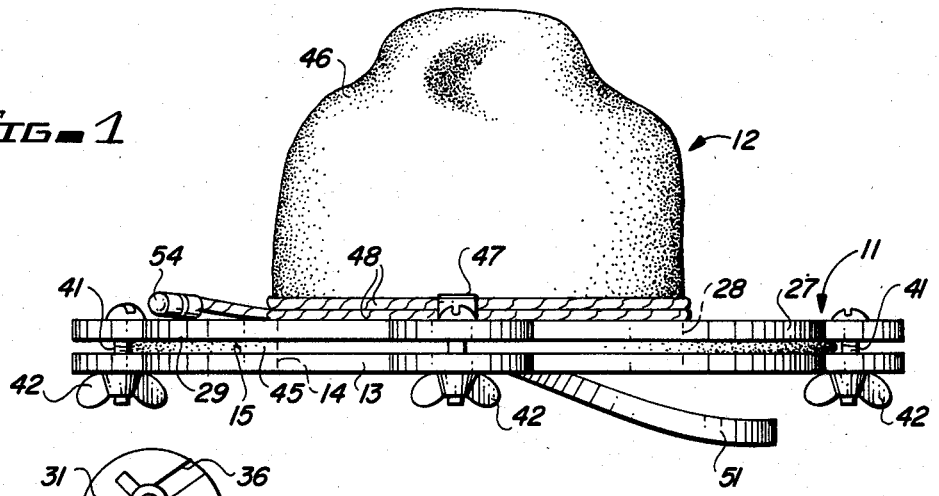
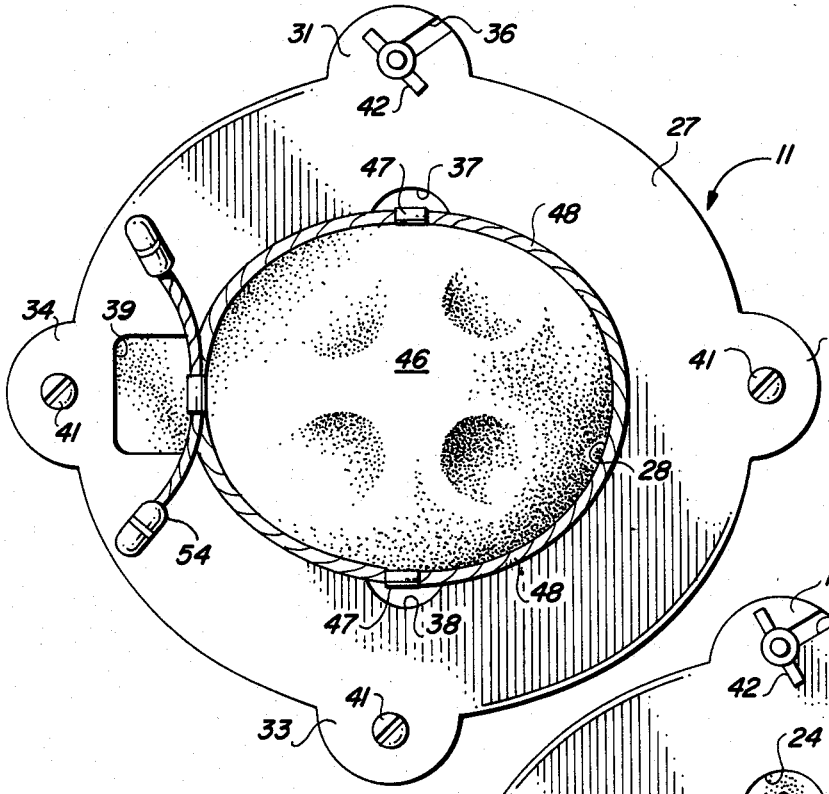
FIG. 2
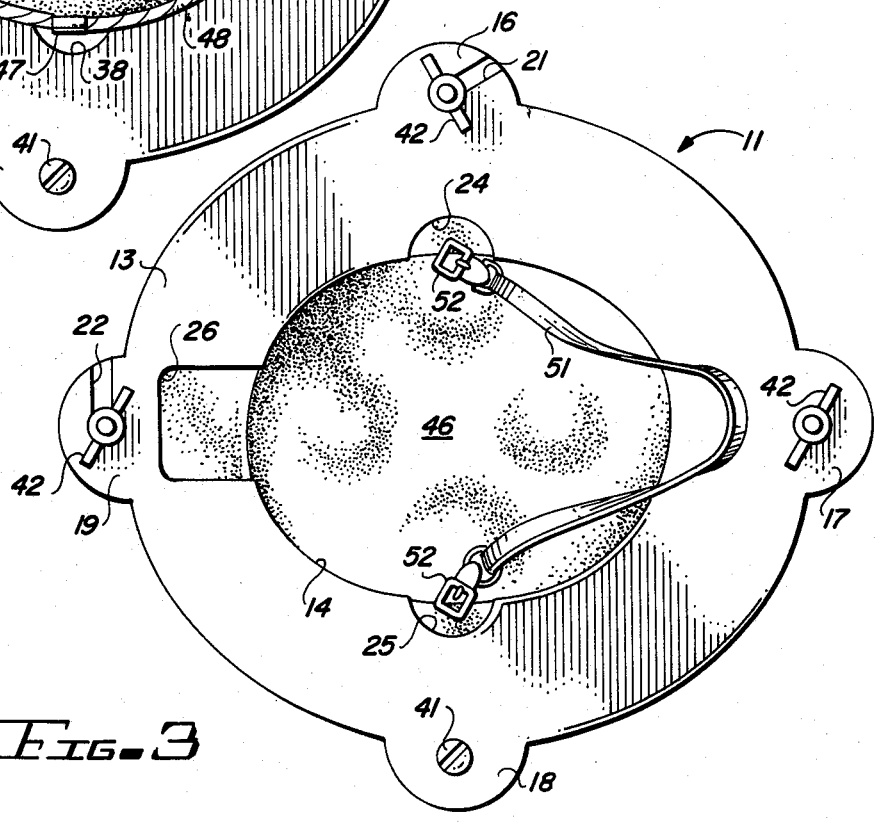
FIG. 3

HAT BRIM PRESS

BACKGROUND OF THE INVENTION

This invention relates generally to a press for hat brims and, more particularly, to a press for hats having flat brims.

Officers and Troopers of various law enforcement groups are often attired in campaign type hats. During periods of non-use, such hats are often kept on uneven surfaces such as automobile seats that can induce warping of the hat's flat brims. Even when stored on flat surfaces, environmental conditions such as precipitation, high humidity, sun, etc. encountered either while being worn or subsequently thereto can contribute to warping of the flat brims. Excessive warping of a brim frequently necessitates replacement of the relatively expensive hat.

The object of this invention, therefore, is to provide a device that will retain or restore the planar form of the brims on campaign type hats during periods of non-use.

SUMMARY OF THE INVENTION

The invention is a hat brim press including a base plate with a planar top surface portion for supporting the bottom of a hat brim; a cover plat having an annular, planar bottom surface for engaging the top of the hat brim; the cover plate defining a central opening encircled by the bottom surface and adapted to accommodate a crown attached to the hat brim; and fasteners connecting the base plate and the cover plate and manually adjustable to produce between the top surface portion and the bottom surface forces directed orthogonally thereto, the forces pressing the hat brim between the top surface portion and the bottom surface so as to retain the hat brim in a planar form.

According to one feature of the invention, the cover plate defines a notch in the bottom surface and intersecting the central opening. The notch accommodates an adornment supported by the brim so as to prevent interference between the top and bottom surfaces.

According to other features of the invention, the cover plate further defines a pair of cover cutouts intersecting opposite edges of the central opening and the base plate defines a central aperture aligned with the central opening and a pair of base cutouts intersecting opposite edges of the central aperture and each aligned with a different one of the cover cutouts. The cutouts accommodate a chin strap used with the hat and prevent interference thereof between the top and bottom surfaces.

According to still other features of the invention, the central opening has the form of an eclipse, the notch is aligned with the major axis thereof, and the base and cover cutouts are aligned with the minor axis thereof. This arrangement renders the press suitable for use with typical campaign hats.

According to additional features of the invention, the base plate further defines a plurality of spaced apart base tab portions extending outwardly from the surface portion, the cover plate further defines a plurality of cover tab portions each aligned with a different one of the base tab portions, and each pair of the aligned base and cover tab portions is connected by one of the fasteners. This arrangement facilitates the production of forces around the periphery of the brim.

According to yet other features of the invention, the fasteners include a hinge permitting relative pivotal movement between the base plate and the cover plate in the planes defined by the planar top surface portion and the planar bottom surface; the fasteners other than the hinge each comprise a nut and bolt assembly; and predetermined ones of the base and cover tabs define open ended slots, each receiving one of the bolts and accommodating movement thereof during the relative pivotal movement between the base and cover plates. This arrangement simplifies the procedure required to insert or remove a hat from the press.

DESCRIPTION OF THE DRAWINGS

These and other objects and features of the invention will become more apparent upon a perusal of the following description taken in conjunction with the accompanying drawings wherein:

FIG. 1 is a schematic side elevational view of the invention;

FIG. 2 is a schematic top view of the invention shown in FIG. 1;

FIG. 3 is a schematic bottom view of the invention shown in FIG. 1; and

DESCRIPTION OF THE PREFERRED EMBODIMENT

Figure 4:
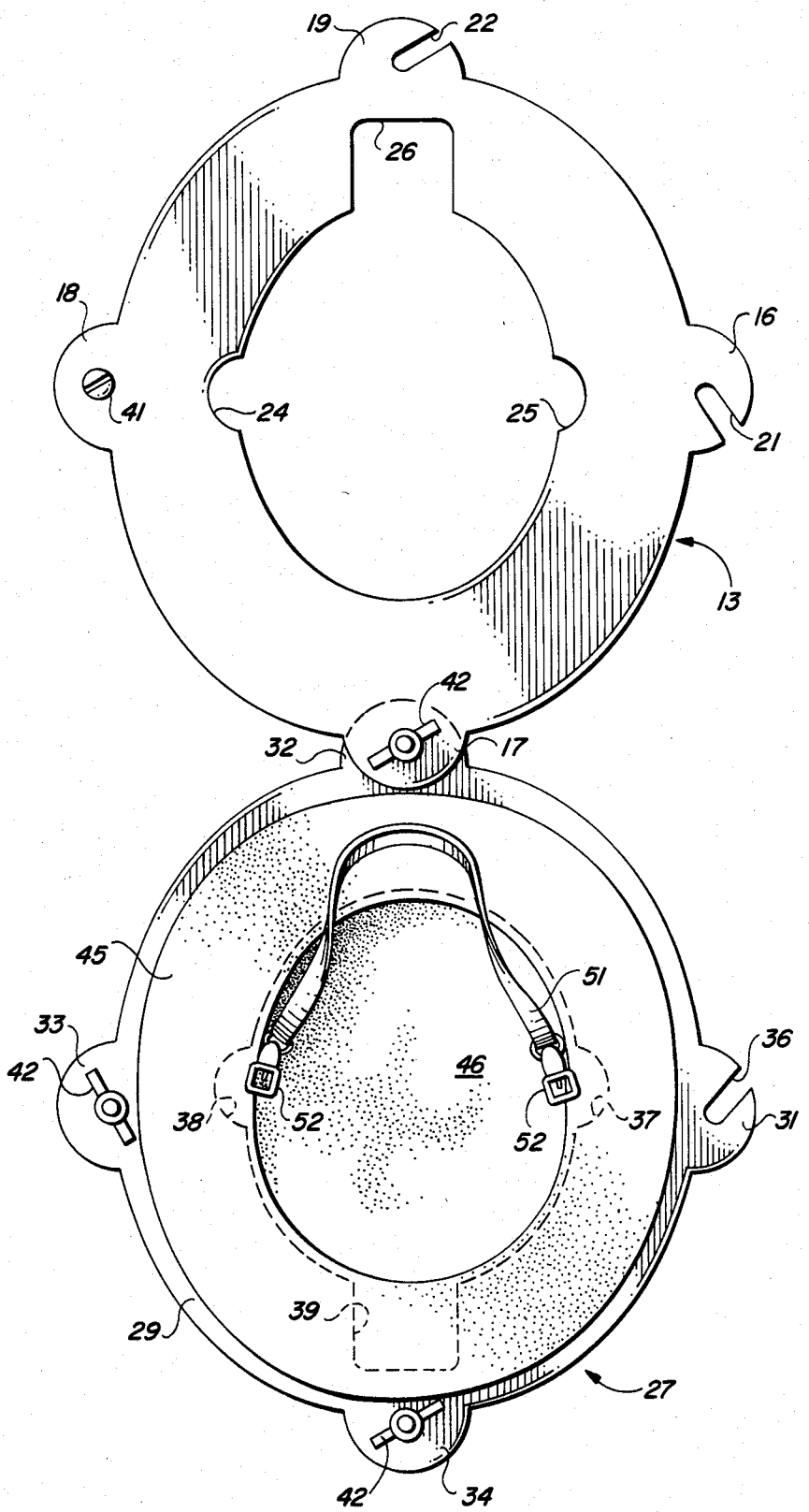
FIG. 4 is a schematic bottom view of the invention pivoted into an open position.

The invention is a brim press 11 for a campaign type hat 12 during periods of non-use. The press 11 includes a base plate 13 that defines a central aperture 14 encircled by an annular, planar top surface portion 15. As shown most clearly in FIG. 3, four quadrantly spaced apart tabs 16–19 project outwardly from the outer periphery of the planar surface 15. Bolt holes are formed in the tabs 17, 18 while open ended slots 21, 22 are formed, respectively, in the tabs 16, 19. Also formed in the base plate 13 are pair of base cutouts 24, 25 that intersect opposite edges of aperture 14. Also intersecting the aperture 14 and uniformly spaced between the base cutouts 24, 25 is a notch 26 in the base plate 13.

Another member of the press 11 is a cover plate 27 that defines a central opening 28 aligned with the central aperture 14 in the base plate 13. Defined by the cover plate 27 and encircling the central aperture 28 is an annular, planar bottom surface 29. A shown most clearly in FIG. 2, the cover plate 27 includes four spaced apart tabs 31–34 projecting outwardly from the outer edge of the planar surface 29 and aligned, respectively, with the tabs 16–19 on the base plate 13. The tabs 32–34 are provided with bolt holes while the tab 31 is provided with an open ended slot 36. Formed in the cover plate 27 and intersecting opposite edges of the central opening 28 are cover cutouts 37, 38 aligned, respectively, with the base cutouts 25, 24. A notch 39 also is formed in the cover plate 27 and intersects the central opening 28 in a position uniformly spaced from the cover cutouts 37, 38 and aligned with the notch 26 in the base plate 13.

Connecting the base plate 13 and the cover plate 27 are four fastener assembies each consisting of a threaded bolt 41 and a wing nut 42. The bolts 41 extend through, respectively, the bolt holes in the aligned tabs 17, 32 the hole in the tab 34 and slot 22 in the tab 19, the slot 36 in the tab 31 and the hole in the tab 18, and the hole in the tab 33 and the slot 21 in the tab 16.

When in the operative position shown in FIGS. 1–3, the press 11 retains a flat brim 45 of the hat 12. An upper surface of the brim 45 is engaged by the planar surface 29 of the cover plate 27 while a lower surface of the brim 45 is engaged by the planar surface portion 15 of the base plate 13. Accommodating a crown portion 46 of the hat 12 is the central opening 28 in the cover plate 27. Upper end portions 47 of a chin strap are secured to a braided cord 48 that extends around the base of the crown 46. A lower chin strap portion 51 extends through openings in the brim 45 and out of the central aperture 14 in the base member 13. The strap 47, 48 and length adjusting buckles 52 thereon are accommodated by the aligned base and cover cutouts 25, 37 and 24, 38. Retained at the base of the crown 46 by the cord 48 is an acorn adornment 54. The acorn 54 is accommodated by the notch 39 in the cover plate 27. To enable the press 11 to properly accommodate the hat 12, the central aperture 14 and the central opening 28 are in the form of elipses with minor axes aligned with the cutouts 24, 25 and 37, 38 and major axes aligned with the notches 26, 39 as shown in FIGS. 2 and 3.

Prior to insertion of the hat 12 the base plate 13 and cover plate 27 are pivoted in the planes of the planar surfaces 15, 29 into the relative positions shown in FIG. 4. During this movement the bolt 41 extending through the tabs 17, 32 functions as a pivot hinge while the slots 21, 22 and 36 in the tabs 16, 19, 31, respectively, permit movement of the other bolts 41. The crown 46 of the hat 12 then is inserted through the central opening 28 in the cover plate 27 until the upper surface of the brim 45 engages the planar surface 29. Next, the base plate 13 is pivoted back into the position shown in FIGS. 1–3. During this operation, movement of the bolts 41 again is permitted by the slots 21, 22 and 36. The wing nuts 42 the are tightened to produce between the base plate 13 and the cover plate 27 forces orthogonal to the planar surfaces 15, 29. These forces press the brim 45 on diametrically disposed portions between the planar surfaces 15, 29 to either retain or restore its flatened form. Intimate contact between the brim 45 and surfaces 15, 29 is facilitated by the notch 39 and the cutouts 24, 25, 37 and 38 that prevent interference by the chin strap portion 48 and the acorn 54.

Obviously, many modifications and variations of the present invention are possible in light of the above teachings. It is to be understood, therefore, that the invention can be practiced otherwise than as specifically described.

What is claimed is:

1. A hat brim press comprising:

a base plate including a planar top surface portion for supporting the bottom of a hat brim;

a cover plate including an annular, planar bottom surface for engaging the top of the hat brim; said cover plate defining a central opening encircled by said bottom surface and adapted to accommodate a crown attached to the hat brim and a notch in said bottom surface and intersecting said central opening, said notch adapted to accommodate an adornment supported by the brim; and fastening means connecting said base plate and said cover plate and manually adjustable to produce between said top surface portion and said bottom surface forces directed orthogonally thereto, said forces pressing the hat brim between said top surface portion and said bottom surface so as to retain the hat brim in a planar form.

2. A hat brim press according to claim 1 wherein said cover plate further defines a pair of cover cutouts intersecting opposite edges of said opening; and said base plate defines a central aperture aligned with said central opening and a pair of base cutouts intersecting opposite edges of said central aperture and each aligned with a different one of said cover cutouts.

3. A hat brim press according to claim 2 wherein said notch is spaced substantially uniformly between said cover cutouts.

4. A hat brim press according to claim 3 wherein said central opening has the form of an eclipse, said notch is aligned with the major axis thereof, and said cover cutouts are aligned with the minor axis thereof.

5. A hat press according to claim 4 wherein said fastening means comprises a plurality of fasteners each connected between said base plate and said cover plate at spaced apart positions thereon.

6. A hat brim press according to claim 5 wherein said base plate further defines a plurality of spaced apart base tab portions extending outwardly from said surface portion, said cover plate further defines a plurality of cover tab portions each aligned with a different one of said base tab portions, and each pair of said aligned base and cover tab portions is connected by one of said fasteners.

7. A hat brim press according to claim 6 wherein one of said fasteners comprises hinge means permitting relative pivotal movement between said base plate and said cover plate in the planes defined by said planar top surface portion and said planar bottom surface.

8. A hat brim press according to claim 7 wherein said fasteners other than said one fastener each comprises a nut and bolt assembly.

9. A hat brim press according to claim 8 wherein predetermined ones of said tabs define open ended slots, each receiving one of said bolts and accommodating movement thereof during said relative pivotal movement between said base and cover plates.

10. A hat brim press according to claim 9 wherein said predetermined one of said tabs comprise both base and cover tabs.

11. A hat brim press comprising:

a base plate including a planar top surface portion for supporting the bottom of a hat brim;

a cover plate including an annular, planar bottom surface for engaging the top of the hat brim; said cover plate defining a central opening encircled by said bottom surface and adapted to accommodate a crown attached to the hat brim; and fastening means connecting and aligning said base plate in positions engaging the hat brim and said cover plate and manually adjustable to produce between said top surface portion and said bottom surface forces directed orthogonally thereto, said forces pressing on diametrically disposed portions of the hat brim between said top surface portion and said bottom surface so as to retain the hat brim in a planar form, and wherein said fastening means comprises hinge means permitting relative pivotal movement between said base plate and said cover plate out of said aligned positions in the planes defined by said planar top surface portion and said planar bottom surface.

12. A hat brim press according to claim 11 wherein said cover plate further defines a pair of cover cutouts intersecting opposite edges of said opening; and said base plate defines a central aperture aligned with said central opening and a pair of base cutouts intersecting opposite edges of said central aperture and each aligned with a different one of said cover cutouts.

13. A hat brim press according to claim 11 wherein said fastening means comprises a plurality of fasteners each connected between said base plate and said cover plate at spaced apart positions thereon.

14. A hat brim press according to claim 13 wherein said base plate further defines a plurality of spaced apart base tab portions extending outwardly from said surface portion, said cover plate further defines a plurality of cover tab portions each aligned with a different one of said base tab portions, and each pair of said aligned base and cover tab portions is connected by one of said fasteners.

15. A hat brim press according to claim 14 wherein said fasteners other than said one fastener each comprises a nut and bolt assembly.

16. A hat brim press according to claim 15 wherein predetermined ones of said tabs define open ended slots, each receiving one of said bolts and accommodating movement thereof during said relative pivotal movement between said base and cover plates.

17. A hat brim press according to claim 16 wherein said predetermined one of said tabs comprise both base and cover tabs.

* * * * *